US011994016B2

(12) United States Patent
Xiao et al.

(10) Patent No.: US 11,994,016 B2
(45) Date of Patent: May 28, 2024

(54) DOWNHOLE PHASE SEPARATION IN DEVIATED WELLS

(71) Applicant: Saudi Arabian Oil Company, Dhahran (SA)

(72) Inventors: Jinjiang Xiao, Dhahran (SA); Eiman Hassan Al Munif, Saihat (SA)

(73) Assignee: Saudi Arabian Oil Company, Dhahran (SA)

( * ) Notice: Subject to any disclaimer, the term of this patent is extended or adjusted under 35 U.S.C. 154(b) by 50 days.

(21) Appl. No.: 17/547,006

(22) Filed: Dec. 9, 2021

(65) Prior Publication Data

US 2023/0184077 A1 Jun. 15, 2023

(51) Int. Cl.

| | |
|---|---|
| ***E21B 43/38*** | (2006.01) |
| ***E21B 33/12*** | (2006.01) |
| ***E21B 43/12*** | (2006.01) |
| ***E21B 43/34*** | (2006.01) |

(52) U.S. Cl.

CPC ..... *E21B 43/385* (2013.01); *E21B 33/12* (2013.01); *E21B 43/121* (2013.01); *E21B 43/35* (2020.05)

(58) Field of Classification Search

CPC ..... E21B 43/385; E21B 33/12; E21B 43/121; E21B 43/35

See application file for complete search history.

(56) References Cited

U.S. PATENT DOCUMENTS

| | | | | |
|---|---|---|---|---|
| 335,164 | A | 2/1886 | Vitalis | |
| 646,887 | A | 4/1900 | Stowe et al. | |
| 1,485,504 | A | 3/1924 | Hollander | |
| 1,559,155 | A | 10/1925 | Bullock | |
| 1,674,815 | A * | 6/1928 | Barnhart | E21B 43/121 166/265 |
| 1,912,452 | A | 6/1933 | Hollander | |
| 1,941,442 | A | 12/1933 | Moran et al. | |
| 1,978,277 | A | 10/1934 | Noble | |
| 2,204,857 | A | 6/1940 | Aladar | |

(Continued)

FOREIGN PATENT DOCUMENTS

| | | |
|---|---|---|
| CA | 1226325 | 9/1987 |
| CA | 2629578 | 10/2009 |

(Continued)

OTHER PUBLICATIONS

"Echo Dissolvable Fracturing Plug," EchoSeries, Dissolvable Fracturing Plugs, Gryphon Oilfield Solutions, Aug. 2018, 1 page.

(Continued)

*Primary Examiner* — Steven A MacDonald
(74) *Attorney, Agent, or Firm* — Fish & Richardson P.C.

(57) ABSTRACT

A packer, disposed in a deviated portion of a well, seals with an inner wall of the well. A first tubular, extending through the packer, receives a wellbore fluid via first inlet. A first outlet of the first tubular discharges the wellbore fluid into an annulus within the well, uphole of the packer. A second tubular, coupled to the first tubular, receives at least a liquid portion of the wellbore fluid via a second inlet. The second tubular directs the liquid portion of the wellbore fluid to a downhole artificial lift system. A sump, defined by a region of an annulus between the inner wall of the well and the first tubular, receives at least a portion of solid material carried by the wellbore fluid.

13 Claims, 3 Drawing Sheets

(56) References Cited

U.S. PATENT DOCUMENTS 2,216,315 A 10/1940 Aladar
2,287,027 A 6/1942 Cummins
2,407,987 A 9/1946 Landberg
2,556,435 A 6/1951 Moehrl
2,625,110 A 1/1953 Haentjens et al.
2,641,191 A 6/1953 Alfred
2,643,723 A 6/1953 Lynes
2,782,720 A 2/1957 Dochterman
2,845,869 A 8/1958 Herbenar
2,866,417 A 12/1958 Otto
2,931,384 A 4/1960 Clark
3,007,418 A 11/1961 Brundage et al.
3,022,739 A 2/1962 Herrick et al.
3,034,484 A 5/1962 Stefancin
3,038,698 A 6/1962 Troyer
3,075,743 A 1/1963 Sheets
3,123,010 A 3/1964 Witt et al.
3,126,755 A 3/1964 Luck
3,129,875 A 4/1964 Cirillo
3,132,595 A 5/1964 Bower
3,139,835 A 7/1964 Wilkinson
3,171,355 A 3/1965 Harris et al.
3,175,403 A 3/1965 Nelson
3,175,618 A 3/1965 Lang et al.
3,213,797 A 10/1965 McMahan
3,229,642 A 1/1966 Lobanoff
3,251,226 A 5/1966 Cushing
3,272,130 A 9/1966 Mosbacher
3,413,925 A 12/1968 Campolong
3,433,163 A 3/1969 Brancart
3,448,305 A 6/1969 Raynal et al.
3,462,082 A 8/1969 Everett
3,516,765 A 6/1970 Boyadjieff
3,558,936 A 1/1971 Horan
3,638,732 A 2/1972 Huntsinger et al.
3,663,845 A 5/1972 Apstein
3,680,989 A 8/1972 Brundage
3,724,503 A 4/1973 Cooke
3,771,910 A 11/1973 Laing
3,795,145 A 3/1974 Miller
3,839,914 A 10/1974 Modisette et al.
3,874,812 A 4/1975 Hanagarth
3,906,792 A 9/1975 Miller
3,918,520 A 11/1975 Hutchison
3,961,758 A 6/1976 Morgan
3,970,877 A 7/1976 Russell et al.
3,975,117 A 8/1976 Carter
3,981,626 A 9/1976 Onal
4,025,244 A 5/1977 Sato
4,096,211 A 6/1978 Rameau
4,127,364 A 11/1978 Eiermann
4,139,330 A 2/1979 Neal
4,154,302 A 5/1979 Cugini
4,181,175 A 1/1980 McGee et al.
4,226,275 A 10/1980 Frosch
4,266,607 A 5/1981 Halstead
4,289,199 A 9/1981 McGee
4,336,415 A 6/1982 Walling
4,374,530 A 2/1983 Walling
4,387,318 A 6/1983 Kolm et al.
4,387,685 A 6/1983 Abbey
4,417,474 A 11/1983 Elderton
4,425,965 A 1/1984 Bayh, III et al.
4,440,221 A 4/1984 Taylor et al.
4,476,923 A 10/1984 Walling
4,491,176 A 1/1985 Reed
4,497,185 A 2/1985 Shaw
4,536,674 A 8/1985 Schmidt
4,576,043 A 3/1986 Nguyen
4,580,634 A 4/1986 Cruise
4,582,131 A 4/1986 Plummer et al.
4,586,854 A 5/1986 Newman et al.
4,619,323 A 10/1986 Gidley
4,627,489 A 12/1986 Reed
4,632,187 A 12/1986 Bayh, III et al.
4,658,583 A 4/1987 Shropshire
4,662,437 A 5/1987 Renfro
4,665,981 A 5/1987 Hayatdavoudi
4,676,308 A * 6/1987 Chow ..... E21B 43/38 96/206
4,685,523 A 8/1987 Paschal, Jr. et al.
4,741,668 A 5/1988 Bearden et al.
4,757,709 A 7/1988 Czernichow
RE32,866 E 2/1989 Cruise
4,838,758 A 6/1989 Sheth
4,850,812 A 7/1989 Voight
4,856,344 A 8/1989 Hunt
4,867,633 A 9/1989 Gravelle
4,969,364 A 11/1990 Masuda
4,986,739 A 1/1991 Child
5,033,937 A 7/1991 Wilson
5,094,294 A 3/1992 Bayh, III et al.
5,113,379 A 5/1992 Scherbatskoy
5,150,619 A 9/1992 Turner
5,158,440 A 10/1992 Cooper et al.
5,169,286 A 12/1992 Yamada
5,180,014 A 1/1993 Cox
5,195,882 A 3/1993 Freeman
5,201,848 A 4/1993 Powers
5,209,650 A 5/1993 Lemieux
5,224,182 A 6/1993 Murphy et al.
5,240,073 A * 8/1993 Bustamante ..... E21B 43/38 166/115
5,246,336 A 9/1993 Furukawa
5,261,796 A 11/1993 Niemiec et al.
5,269,377 A 12/1993 Martin
5,285,008 A 2/1994 Sas-Jaworsky et al.
5,301,760 A 4/1994 Graham
5,317,223 A 5/1994 Kiesewetter et al.
5,319,272 A 6/1994 Raad
5,323,661 A 6/1994 Cheng
5,334,801 A 8/1994 Mohn
5,335,542 A 8/1994 Ramakrishnan et al.
5,337,603 A 8/1994 McFarland et al.
5,358,378 A 10/1994 Holscher
5,375,622 A 12/1994 Houston
5,482,117 A 1/1996 Kolpak
5,494,413 A 2/1996 Campen et al.
5,591,922 A 1/1997 Segeral et al.
5,605,193 A 2/1997 Bearden et al.
5,613,311 A 3/1997 Burtch
5,613,555 A 3/1997 Sorem et al.
5,620,048 A 4/1997 Beauquin
5,641,915 A 6/1997 Ortiz
5,649,811 A 7/1997 Krol, Jr. et al.
5,653,585 A 8/1997 Fresco et al.
5,693,891 A 12/1997 Brown
5,708,500 A 1/1998 Anderson
5,736,650 A 4/1998 Hiron et al.
5,755,288 A 5/1998 Bearden et al.
5,834,659 A 11/1998 Ortiz
5,845,709 A 12/1998 Mack et al.
5,848,642 A 12/1998 Sola
5,880,378 A 3/1999 Behring
5,886,267 A 3/1999 Ortiz et al.
5,892,860 A 4/1999 Maron et al.
5,905,208 A 5/1999 Ortiz et al.
5,908,049 A 6/1999 Williams et al.
5,921,285 A 7/1999 Quigley et al.
5,939,813 A 8/1999 Schob
5,954,305 A 9/1999 Calabro
5,965,964 A 10/1999 Skinner et al.
5,975,205 A 11/1999 Carisella
6,044,906 A 4/2000 Saltel
6,068,015 A 5/2000 Pringle
6,082,455 A 7/2000 Pringle et al.
6,113,675 A 9/2000 Branstetter
6,129,507 A 10/2000 Ganelin
6,148,866 A 11/2000 Quigley et al.
6,155,102 A 12/2000 Toma
6,164,308 A 12/2000 Butler
6,167,965 B1 1/2001 Bearden et al.
6,176,323 B1 1/2001 Weirich
6,179,269 B1 1/2001 Kobylinski et al.

(56) References Cited

U.S. PATENT DOCUMENTS 6,192,983 B1 2/2001 Neuroth et al.
6,193,079 B1 2/2001 Weimer
6,209,652 B1 4/2001 Portman et al.
6,257,332 B1 7/2001 Vidrine et al.
6,264,440 B1 7/2001 Klein et al.
6,286,558 B1 9/2001 Quigley et al.
6,289,990 B1 9/2001 Dillon et al.
6,298,917 B1 10/2001 Kobylinski et al.
6,325,143 B1 12/2001 Scarsdale
6,357,485 B2 3/2002 Quigley et al.
6,357,530 B1 3/2002 Kennedy
6,361,272 B1 3/2002 Bassett
6,413,065 B1 7/2002 Dass
6,414,239 B1 7/2002 Gasque, Jr.
6,427,778 B1 8/2002 Beall et al.
6,454,010 B1 9/2002 Thomas et al.
6,463,810 B1 10/2002 Liu
6,504,258 B2 1/2003 Schultz et al.
6,530,211 B2 3/2003 Holtzapple et al.
6,544,013 B2 4/2003 Kato et al.
6,546,812 B2 4/2003 Lewis
6,547,519 B2 4/2003 deBlanc et al.
6,550,327 B1 4/2003 Van Berk
6,557,642 B2 5/2003 Head
6,578,638 B2 6/2003 Guillory et al.
6,588,266 B2 7/2003 Tubel et al.
6,601,460 B1 8/2003 Materna
6,601,651 B2 8/2003 Grant
6,604,550 B2 8/2003 Quigley et al.
6,629,564 B1 10/2003 Ramakrishnan et al.
6,679,692 B1 1/2004 Feuling et al.
6,681,894 B1 1/2004 Fanguy
6,726,449 B2 4/2004 James et al.
6,728,165 B1 4/2004 Roscigno et al.
6,733,249 B2 5/2004 Maier et al.
6,741,000 B2 5/2004 Newcomb
6,755,609 B2 6/2004 Preinfalk
6,768,214 B2 7/2004 Schultz et al.
6,776,054 B1 8/2004 Stephenson
6,779,601 B2 8/2004 Wilson
6,807,857 B2 10/2004 Storm, Jr.
6,808,371 B2 10/2004 Niwatsukino et al.
6,811,382 B2 11/2004 Buchanan et al.
6,848,539 B2 2/2005 Lee et al.
6,856,132 B2 2/2005 Appel et al.
6,857,452 B2 2/2005 Quigley et al.
6,857,920 B2 2/2005 Marathe et al.
6,863,137 B2 3/2005 Terry et al.
6,913,079 B2 7/2005 Tubel
6,920,085 B2 7/2005 Finke et al.
6,932,160 B2 8/2005 Murray et al.
6,935,189 B2 8/2005 Richards
6,973,972 B2 12/2005 Aronstam
6,993,979 B2 2/2006 Segeral
7,017,681 B2 3/2006 Ivannikov et al.
7,021,905 B2 4/2006 Torrey et al.
7,032,662 B2 4/2006 Malone et al.
7,086,294 B2 8/2006 DeLong
7,093,665 B2 8/2006 Dass
7,104,321 B2 * 9/2006 Carruth ..... B01D 19/0042 166/265
7,107,860 B2 9/2006 Jones
7,199,480 B2 4/2007 Fripp et al.
7,224,077 B2 5/2007 Allen
7,226,279 B2 6/2007 Andoskin et al.
7,242,103 B2 7/2007 Tips
7,249,805 B2 7/2007 Cap
7,259,688 B2 8/2007 Hirsch et al.
7,262,532 B2 8/2007 Seidler et al.
7,275,592 B2 10/2007 Davis
7,275,711 B1 10/2007 Flanigan
7,338,262 B2 3/2008 Gozdawa
7,345,372 B2 3/2008 Roberts et al.
7,377,312 B2 5/2008 Davis
7,410,003 B2 8/2008 Ravensbergen et al.
7,647,948 B2 1/2010 Quigley et al.
7,668,411 B2 2/2010 Davies et al.
7,670,122 B2 3/2010 Phillips et al.
7,670,451 B2 3/2010 Head
7,699,099 B2 4/2010 Bolding et al.
7,730,937 B2 6/2010 Head
7,762,715 B2 7/2010 Gordon et al.
7,770,650 B2 8/2010 Young et al.
7,775,763 B1 8/2010 Johnson et al.
7,819,640 B2 10/2010 Kalavsky et al.
7,841,395 B2 11/2010 Gay et al.
7,841,826 B1 11/2010 Phillips
7,847,421 B2 12/2010 Gardner et al.
7,849,928 B2 12/2010 Collie
7,905,295 B2 3/2011 Mack
7,906,861 B2 3/2011 Guerrero et al.
7,946,341 B2 5/2011 Hartog et al.
8,013,660 B2 9/2011 Fitzi
8,016,545 B2 9/2011 Oklejas et al.
8,047,232 B2 11/2011 Bernitsas
8,066,033 B2 11/2011 Quigley et al.
8,067,865 B2 11/2011 Savant
8,141,625 B2 * 3/2012 Reid ..... E21B 43/128 166/265
8,197,602 B2 6/2012 Baron
8,235,126 B2 8/2012 Bradley
8,258,644 B2 9/2012 Kaplan
8,261,841 B2 9/2012 Bailey et al.
8,302,736 B1 11/2012 Olivier
8,337,142 B2 12/2012 Eslinger et al.
8,408,064 B2 4/2013 Hartog et al.
8,419,398 B2 4/2013 Kothnur et al.
8,421,251 B2 4/2013 Pabon et al.
8,426,988 B2 4/2013 Hay
8,493,556 B2 7/2013 Li et al.
8,506,257 B2 8/2013 Bottome
8,564,179 B2 10/2013 Ochoa et al.
8,568,081 B2 10/2013 Song et al.
8,579,617 B2 11/2013 Ono et al.
8,604,634 B2 12/2013 Pabon et al.
8,638,002 B2 1/2014 Lu
8,648,480 B1 2/2014 Liu et al.
8,771,499 B2 7/2014 McCutchen et al.
8,786,113 B2 7/2014 Tinnen et al.
8,821,138 B2 9/2014 Holtzapple et al.
8,905,728 B2 12/2014 Blankemeier et al.
8,916,983 B2 12/2014 Marya et al.
8,925,649 B1 1/2015 Wiebe et al.
8,936,430 B2 1/2015 Bassett
8,948,550 B2 2/2015 Li et al.
8,950,476 B2 2/2015 Head
8,960,309 B2 2/2015 Davis
8,973,433 B2 3/2015 Mulford
9,022,106 B1 * 5/2015 McCoy ..... E21B 43/38 166/105.5
9,080,336 B1 7/2015 Yantis
9,091,144 B2 7/2015 Swanson et al.
9,106,159 B1 8/2015 Wiebe et al.
9,109,429 B2 8/2015 Xu et al.
9,130,161 B2 9/2015 Nair et al.
9,133,709 B2 9/2015 Huh et al.
9,140,815 B2 9/2015 Lopez et al.
9,157,297 B2 10/2015 Williamson, Jr.
9,170,149 B2 10/2015 Hartog et al.
9,200,932 B2 12/2015 Sittler
9,203,277 B2 12/2015 Kori et al.
9,234,529 B2 1/2016 Meuter
9,239,043 B1 1/2016 Zeas
9,321,222 B2 4/2016 Childers et al.
9,322,389 B2 4/2016 Tosi
9,353,614 B2 5/2016 Roth et al.
9,383,476 B2 7/2016 Trehan
9,499,460 B2 11/2016 Kawamura et al.
9,500,073 B2 11/2016 Alan et al.
9,518,458 B2 * 12/2016 Ellithorp ..... E21B 43/38
9,540,908 B1 1/2017 Olivier
9,574,438 B2 2/2017 Flores
9,581,489 B2 2/2017 Skinner
9,587,456 B2 3/2017 Roth

(56) References Cited

U.S. PATENT DOCUMENTS 9,593,561 B2 3/2017 Xiao et al.
9,599,460 B2 3/2017 Wang et al.
9,599,505 B2 3/2017 Lagakos et al.
9,617,847 B2 4/2017 Jaaskelainen et al.
9,631,482 B2 4/2017 Roth et al.
9,677,560 B1 6/2017 Davis et al.
9,757,796 B2 9/2017 Sherman et al.
9,759,025 B2 9/2017 Vavik
9,759,041 B2 9/2017 Osborne
9,784,077 B2 10/2017 Gorrara
9,880,096 B2 1/2018 Bond et al.
9,903,010 B2 2/2018 Doud et al.
9,915,134 B2 3/2018 Xiao et al.
9,932,806 B2 4/2018 Stewart
9,951,598 B2 4/2018 Roth et al.
9,964,533 B2 5/2018 Ahmad
9,976,381 B2 5/2018 Martin et al.
9,982,519 B2 5/2018 Melo
10,100,596 B2 10/2018 Roth et al.
10,115,942 B2 10/2018 Qiao et al.
10,138,885 B2 11/2018 Ejim et al.
10,151,194 B2 12/2018 Roth et al.
10,209,383 B2 2/2019 Barfoot et al.
10,253,610 B2 4/2019 Roth et al.
10,273,399 B2 4/2019 Cox et al.
10,280,727 B2 * 5/2019 Saponja ..... E21B 43/121
10,287,853 B2 5/2019 Ejim et al.
10,308,865 B2 6/2019 Cox et al.
10,323,644 B1 6/2019 Shakirov et al.
10,337,302 B2 7/2019 Roth et al.
10,337,312 B2 7/2019 Xiao et al.
10,352,125 B2 7/2019 Frazier
10,367,434 B2 7/2019 Ahmad
10,378,322 B2 8/2019 Ejim et al.
10,465,477 B2 11/2019 Abdelaziz et al.
10,465,484 B2 11/2019 Turner et al.
10,487,259 B2 11/2019 Cox et al.
10,501,682 B2 12/2019 Cox et al.
10,533,558 B2 1/2020 Melo et al.
10,578,111 B2 3/2020 Xiao et al.
10,584,702 B2 3/2020 Melo
10,590,751 B2 3/2020 Saponja et al.
10,677,031 B2 6/2020 Xiao
10,731,441 B2 8/2020 Xiao
10,844,701 B2 11/2020 Xiao et al.
10,851,596 B2 12/2020 Roth et al.
10,900,315 B2 1/2021 Xiao
10,941,778 B2 3/2021 Xiao et al.
11,028,682 B1 * 6/2021 Zhang ..... E21B 43/38
11,095,191 B2 8/2021 Wrighton
11,162,340 B2 11/2021 Xiao
11,162,493 B2 11/2021 Melo et al.
11,220,890 B2 1/2022 Xiao
2001/0036334 A1 11/2001 Choa
2002/0043404 A1 4/2002 Trueman et al.
2002/0074742 A1 6/2002 Quoiani
2002/0079100 A1 6/2002 Simpson
2002/0109080 A1 8/2002 Tubel et al.
2002/0121376 A1 9/2002 Rivas
2002/0153141 A1 10/2002 Hartman
2003/0079880 A1 5/2003 Deaton et al.
2003/0141071 A1 7/2003 Hosie
2003/0161739 A1 8/2003 Chu et al.
2003/0185676 A1 10/2003 James
2003/0226395 A1 12/2003 Storm et al.
2004/0013547 A1 1/2004 Allen
2004/0060705 A1 4/2004 Kelley
2005/0047779 A1 3/2005 Jaynes et al.
2005/0098349 A1 5/2005 Krueger et al.
2005/0166961 A1 8/2005 Means
2005/0200210 A1 9/2005 Kotsonis et al.
2005/0217859 A1 10/2005 Hartman
2005/0254943 A1 11/2005 Fukuchi et al.
2006/0066169 A1 3/2006 Daugherty et al.
2006/0076956 A1 4/2006 Sjolie et al.
2006/0086498 A1 4/2006 Wetzel et al.
2006/0096760 A1 5/2006 Ohmer
2007/0012437 A1 1/2007 Clingman et al.
2007/0181304 A1 8/2007 Rankin et al.
2007/0193749 A1 8/2007 Folk
2007/0212238 A1 9/2007 Jacobsen et al.
2007/0220987 A1 9/2007 Clifton et al.
2008/0048455 A1 2/2008 Carney
2008/0093084 A1 4/2008 Knight
2008/0100828 A1 5/2008 Cyr et al.
2008/0187434 A1 8/2008 Neiszer
2008/0236842 A1 10/2008 Bhavsar et al.
2008/0262737 A1 10/2008 Thigpen et al.
2008/0264182 A1 10/2008 Jones
2008/0277941 A1 11/2008 Bowles
2008/0290876 A1 11/2008 Ameen
2008/0292454 A1 11/2008 Brunner
2009/0001304 A1 1/2009 Hansen et al.
2009/0016899 A1 1/2009 Davis
2009/0090513 A1 4/2009 Bissonnette
2009/0110579 A1 4/2009 Amburgey
2009/0151928 A1 6/2009 Lawson
2009/0151953 A1 6/2009 Brown
2009/0166045 A1 7/2009 Wetzel et al.
2009/0255669 A1 10/2009 Ayan et al.
2009/0304322 A1 10/2009 Davies et al.
2009/0289627 A1 11/2009 Johansen et al.
2009/0293634 A1 12/2009 Ong
2010/0040492 A1 2/2010 Eslinger et al.
2010/0122818 A1 5/2010 Rooks
2010/0164231 A1 7/2010 Tsou
2010/0186439 A1 7/2010 Ogata et al.
2010/0206577 A1 8/2010 Martinez
2010/0236794 A1 9/2010 Duan
2010/0244404 A1 9/2010 Bradley
2010/0258306 A1 10/2010 Camilleri
2010/0288493 A1 11/2010 Fielder et al.
2010/0300413 A1 12/2010 Ulrey et al.
2010/0308592 A1 12/2010 Frayne
2011/0017459 A1 1/2011 Dinkins
2011/0024107 A1 2/2011 Sunyovszky et al.
2011/0024231 A1 2/2011 Wurth et al.
2011/0036568 A1 2/2011 Barbosa
2011/0036662 A1 2/2011 Smith
2011/0049901 A1 3/2011 Tinnen
2011/0088462 A1 4/2011 Samson et al.
2011/0155390 A1 6/2011 Lannom et al.
2011/0162832 A1 7/2011 Reid
2011/0169353 A1 7/2011 Endo
2011/0185805 A1 8/2011 Roux et al.
2011/0203848 A1 8/2011 Krueger et al.
2011/0273032 A1 11/2011 Lu
2011/0278094 A1 11/2011 Gute
2011/0296911 A1 12/2011 Moore
2011/0300008 A1 12/2011 Fielder et al.
2012/0012327 A1 1/2012 Plunkett et al.
2012/0018143 A1 1/2012 Lembcke
2012/0018148 A1 1/2012 Bryant et al.
2012/0211245 A1 8/2012 Fuhst et al.
2012/0282119 A1 11/2012 Floyd
2012/0292915 A1 11/2012 Moon
2013/0019673 A1 1/2013 Sroka
2013/0300833 A1 1/2013 Perkins
2013/0048302 A1 2/2013 Gokdag et al.
2013/0051977 A1 2/2013 Song
2013/0066139 A1 3/2013 Wiessler
2013/0068454 A1 3/2013 Armistead
2013/0068481 A1 3/2013 Zhou
2013/0073208 A1 3/2013 Dorovsky
2013/0081460 A1 4/2013 Xiao et al.
2013/0091942 A1 4/2013 Samson et al.
2013/0119669 A1 5/2013 Murphree
2013/0119830 A1 5/2013 Hautz
2013/0136639 A1 5/2013 Simpson
2013/0167628 A1 7/2013 Hull et al.
2013/0175030 A1 7/2013 Ige
2013/0189123 A1 7/2013 Stokley
2013/0200628 A1 8/2013 Kane
2013/0213663 A1 8/2013 Lau et al.

(56) References Cited

U.S. PATENT DOCUMENTS

2013/0227940 A1 9/2013 Greenblatt
2013/0248429 A1 9/2013 Dahule
2013/0255370 A1 10/2013 Roux et al.
2013/0259721 A1 10/2013 Noui-Mehidi
2014/0012507 A1 1/2014 Trehan
2014/0014331 A1 1/2014 Crocker
2014/0027546 A1 1/2014 Kean et al.
2014/0037422 A1 2/2014 Gilarranz
2014/0041862 A1 2/2014 Ersoz
2014/0116720 A1 5/2014 He et al.
2014/0144706 A1 5/2014 Bailey et al.
2014/0167418 A1 6/2014 Hiejima
2014/0175800 A1 6/2014 Thorp
2014/0208855 A1 7/2014 Skinner
2014/0209291 A1 7/2014 Watson et al.
2014/0265337 A1 9/2014 Harding et al.
2014/0265654 A1 9/2014 Satterfield
2014/0284937 A1 9/2014 Dudley et al.
2014/0311737 A1 10/2014 Bedouet et al.
2014/0341714 A1 11/2014 Casa
2014/0343857 A1 11/2014 Pfutzner
2014/0369879 A1 12/2014 Friedman
2014/0377080 A1 12/2014 Xiao et al.
2015/0034580 A1 2/2015 Nakao et al.
2015/0068769 A1 3/2015 Xiao et al.
2015/0071795 A1 3/2015 Vazquez et al.
2015/0075772 A1* 3/2015 Saponja ..... E21B 43/10 166/115
2015/0114127 A1 4/2015 Barfoot et al.
2015/0192141 A1 7/2015 Nowitzki et al.
2015/0204336 A1 7/2015 McManus et al.
2015/0233228 A1 8/2015 Roth
2015/0308245 A1 10/2015 Stewart et al.
2015/0308444 A1 10/2015 Trottman
2015/0318920 A1 11/2015 Johnston
2015/0330194 A1 11/2015 June et al.
2015/0354308 A1 12/2015 June et al.
2015/0354590 A1 12/2015 Kao
2015/0376907 A1 12/2015 Nguyen
2016/0010451 A1 1/2016 Melo
2016/0016834 A1 1/2016 Dahule
2016/0024849 A1 1/2016 Kocis et al.
2016/0164377 A1 6/2016 Gauthier
2016/0168957 A1 6/2016 Tubel
2016/0169231 A1 6/2016 Michelassi et al.
2016/0177659 A1 6/2016 Voll et al.
2016/0273947 A1 9/2016 Mu et al.
2016/0305447 A1 10/2016 Dreiss et al.
2016/0332856 A1 11/2016 Steedley
2017/0012491 A1 1/2017 Schob et al.
2017/0033713 A1 2/2017 Petroni
2017/0038246 A1 2/2017 Coates et al.
2017/0058664 A1 3/2017 Xiao et al.
2017/0074082 A1 3/2017 Palmer
2017/0075029 A1 3/2017 Cuny et al.
2017/0122046 A1 5/2017 Vavik
2017/0138189 A1 5/2017 Ahmad et al.
2017/0159668 A1 6/2017 Nowitzki et al.
2017/0167498 A1 6/2017 Chang
2017/0175752 A1 6/2017 Hofer et al.
2017/0183942 A1 6/2017 Veland
2017/0184097 A1 6/2017 Reeves
2017/0194831 A1 7/2017 Marvel
2017/0235006 A1 8/2017 Ellmauthaler et al.
2017/0241421 A1 8/2017 Markovitch
2017/0260846 A1 9/2017 Jin et al.
2017/0292533 A1 10/2017 Zia
2017/0321695 A1 11/2017 Head
2017/0321711 A1 11/2017 Collins et al.
2017/0328151 A1 11/2017 Dillard
2017/0343006 A1 11/2017 Ehrsann
2017/0346371 A1 11/2017 Gruetzner
2017/0350399 A1 12/2017 Eslinger et al.
2018/0045543 A1 2/2018 Farhadiroushan et al.
2018/0052041 A1 2/2018 Yaman et al.
2018/0058157 A1 3/2018 Melo et al.
2018/0066671 A1 3/2018 Murugan
2018/0128661 A1 5/2018 Munro
2018/0134036 A1 5/2018 Galtarossa et al.
2018/0155991 A1 6/2018 Arsalan et al.
2018/0171763 A1 6/2018 Malbrel et al.
2018/0171767 A1 6/2018 Huynh et al.
2018/0172020 A1 6/2018 Ejim
2018/0202843 A1 7/2018 Artuso et al.
2018/0223642 A1* 8/2018 Zahran ..... E21B 43/08
2018/0223854 A1 8/2018 Brunvold et al.
2018/0226174 A1 8/2018 Rose
2018/0238152 A1 8/2018 Melo
2018/0274311 A1 9/2018 Zsolt
2018/0283155 A1* 10/2018 Saponja ..... E21B 43/38
2018/0284304 A1 10/2018 Barfoot et al.
2018/0306019 A1* 10/2018 Saponja ..... B01D 19/00
2018/0306199 A1 10/2018 Reed
2018/0320059 A1 11/2018 Cox et al.
2018/0340389 A1 11/2018 Wang
2018/0351480 A1 12/2018 Ahmad
2018/0363660 A1 12/2018 Klahn
2019/0025095 A1 1/2019 Steel
2019/0032667 A1 1/2019 Ifrim et al.
2019/0040863 A1 2/2019 Davis et al.
2019/0049054 A1 2/2019 Gunnarsson
2019/0128113 A1 5/2019 Ross et al.
2019/0253003 A1 8/2019 Ahmad
2019/0253004 A1 8/2019 Ahmad
2019/0253005 A1 8/2019 Ahmad
2019/0253006 A1 8/2019 Ahmad
2019/0271217 A1 9/2019 Radov et al.
2019/0368291 A1 12/2019 Xiao et al.
2019/0376371 A1 12/2019 Arsalan
2019/0376378 A1* 12/2019 Saponja ..... E21B 43/38
2020/0018317 A1 1/2020 Landi et al.
2020/0032637 A1* 1/2020 Saponja ..... E21B 43/38
2020/0056462 A1 2/2020 Xiao et al.
2020/0056615 A1 2/2020 Xiao et al.
2020/0220431 A1 7/2020 Wrighton
2020/0248538 A1 8/2020 Xiao et al.
2020/0248695 A1 8/2020 Xiao et al.
2020/0355184 A1 12/2020 Xiao et al.
2021/0002985 A1 1/2021 Xiao
2021/0040826 A1 2/2021 Xiao et al.
2021/0372244 A1 12/2021 Riachentsev et al.

FOREIGN PATENT DOCUMENTS

CN 2168104 6/1994
CN 1507531 6/2004
CN 101328769 12/2008
CN 101328796 12/2008
CN 101592475 12/2009
CN 201496028 6/2010
CN 101842547 9/2010
CN 102471701 5/2012
CN 101488805 8/2012
CN 202851445 4/2013
CN 103185025 7/2013
CN 203420906 2/2014
CN 103913186 7/2014
CN 104100231 10/2014
CN 104141633 11/2014
CN 104533797 4/2015
CN 105043586 11/2015
CN 103835988 1/2016
CN 105239963 1/2016
CN 105422047 3/2016
CN 103717901 6/2016
CN 106133326 11/2016
CN 107144339 9/2017
CN 206496768 9/2017
CN 105371943 6/2018
CN 107664541 6/2018
CN 108534910 9/2018
CN 104236644 12/2018
DE 2260678 6/1974
DE 3022241 12/1981

(56) References Cited

FOREIGN PATENT DOCUMENTS

| | | |
|---|---|---|
| DE | 3444859 | 6/1985 |
| DE | 3520884 | 1/1986 |
| DE | 19654092 | 7/1998 |
| DE | 10307887 | 10/2004 |
| DE | 102007005426 | 5/2008 |
| DE | 102008001607 | 11/2009 |
| DE | 102008054766 | 6/2010 |
| DE | 202012103729 | 10/2012 |
| DE | 102012215023 | 1/2014 |
| DE | 102012022453 | 5/2014 |
| DE | 102013200450 | 7/2014 |
| DE | 102012205757 | 8/2014 |
| EP | 0380148 | 8/1990 |
| EP | 579981 | 1/1994 |
| EP | 0579981 | 1/1994 |
| EP | 0637675 | 2/1995 |
| EP | 1101024 | 5/2001 |
| EP | 1143104 | 10/2001 |
| EP | 1270900 | 1/2003 |
| EP | 1369588 | 12/2003 |
| EP | 2072971 | 6/2009 |
| EP | 2801696 | 12/2014 |
| EP | 2893301 | 5/2018 |
| EP | 3527830 | 8/2019 |
| GB | 670206 | 4/1952 |
| GB | 2166472 | 5/1986 |
| GB | 2173034 | 10/1986 |
| GB | 2218721 | 11/1989 |
| GB | 2226776 | 7/1990 |
| GB | 2283035 | 4/1995 |
| GB | 2348674 | 10/2000 |
| GB | 2477909 | 8/2011 |
| GB | 2504104 | 1/2014 |
| JP | S 57146891 | 9/1982 |
| JP | 4019375 | 1/1992 |
| JP | 2003502155 | 1/2003 |
| JP | 2005076486 | 3/2005 |
| JP | 2006510484 | 3/2006 |
| JP | 2010156172 | 7/2010 |
| JP | 2013110910 | 6/2013 |
| JP | 2014047422 | 3/2014 |
| RU | 98500 | 10/2010 |
| RU | 122531 | 11/2012 |
| RU | 178531 | 4/2018 |
| WO | WO 1993006331 | 4/1993 |
| WO | WO 1995004869 | 2/1995 |
| WO | WO 1998046857 | 10/1998 |
| WO | WO 1999027256 | 6/1999 |
| WO | WO 2002072998 | 9/2002 |
| WO | WO 2005066502 | 7/2005 |
| WO | WO 2006117935 | 11/2006 |
| WO | WO 2009046709 | 4/2009 |
| WO | WO 2009113894 | 9/2009 |
| WO | WO 2009129607 | 10/2009 |
| WO | WO 2011066050 | 6/2011 |
| WO | WO 2011101296 | 8/2011 |
| WO | WO 2011133620 | 10/2011 |
| WO | WO 2011135541 | 11/2011 |
| WO | WO 2012058290 | 5/2012 |
| WO | WO 2012166638 | 12/2012 |
| WO | WO 2013005091 | 1/2013 |
| WO | WO 2013089746 | 6/2013 |
| WO | WO 2013171053 | 11/2013 |
| WO | WO 2014116458 | 7/2014 |
| WO | WO 2014127035 | 8/2014 |
| WO | WO 2014147645 | 9/2014 |
| WO | WO 2015034482 | 3/2015 |
| WO | WO 2015041655 | 3/2015 |
| WO | WO 2015073018 | 5/2015 |
| WO | WO 2015084926 | 6/2015 |
| WO | WO 2015123236 | 8/2015 |
| WO | WO 2016003662 | 1/2016 |
| WO | WO 2016012245 | 1/2016 |
| WO | WO 2016050301 | 4/2016 |
| WO | WO 2016081389 | 5/2016 |
| WO | WO 2016089526 | 6/2016 |
| WO | WO 2016111849 | 7/2016 |
| WO | WO 2016130620 | 8/2016 |
| WO | WO 2016160016 | 10/2016 |
| WO | WO 2016195643 | 12/2016 |
| WO | WO 2017021553 | 2/2017 |
| WO | WO 2017146593 | 8/2017 |
| WO | WO 2018022198 | 2/2018 |
| WO | WO 2018096345 | 5/2018 |
| WO | WO 2018125071 | 7/2018 |
| WO | WO 2018145215 | 8/2018 |
| WO | WO 2019243789 | 12/2019 |
| WO | WO 2020165046 | 8/2020 |

OTHER PUBLICATIONS

"TervAlloy Degradable Magnesium Alloys," Terves Engineered Response, Engineered for Enhanced Completion Efficiency, Feb. 2018, 8 pages.

"Ocean Exploration and Resource Development Technology", Editorial Board of Science and Technology Prospering the Sea Series, Ocean Press, Oct. 31, 2001, pp. 79, 14 pages, English Abstract only.

Abelsson et al., "Development and Testing of a Hybrid Boosting Pump," OTC 21516, Offshore Technology Conference, presented at the Offshore Technology Conference, May 2-5, 2011, 9 pages.

Alhanati et al., "ESP Failures: Can we talk the same language?" SPE paper, SPE ESP Workshop held in Houston, Apr. 25-27, 2001, 11 page.

Alhasan et al., "Extending mature field production life using a multiphase twin screw pump," BHR Group Multiphase 15, 2011, 11 pages.

Baker Hughes, "Multiphase Pump: Increases Efficiency and Production in Wells with High Gast Content," Brochure overview, retrieved from URL <https://assets.www.bakerhughes.com/system/69/00d970d9dd11e3a411ddf3c1325ea6/28592.MVP_Overview.pdf>, 2014, 2 pages.

Bao et al., "Recent development in the distributed fiber optic acoustic and ultrasonic detection," Journal of Lightwave Technology 35:16, Aug. 15, 2017, 12 pages.

Blunt, "Effects of heterogeneity and wetting on relative permeability using pore level modeling," SPE 36762, Society of Petroleum Engineers (SPE), SPE Journal 2:01 (70-87), Mar. 1997, 19 pages.

Bryant and Blunt, "Prediction of relative permeability in simple porous media," Physical Review A 46:4, Aug. 1992, 8 pages.

Bybee et al., "Through-Tubing Completions Maximize Production," SPE-0206-0057, Society of Petroleum Engineers (SPE), Drilling and Cementing Technology, JPT, Feb. 2006, 2 pages.

Champion et al., "The application of high-power sound waves for wellbore cleaning," SPE 82197, Society of Petroleum Engineers International (SPE), presented at the SPE European Formation Damage Conference, May 13-14, 2003, 10 pages.

Chappell and Lancaster, "Comparison of methodological uncertainties within permeability measurements," Wiley InterScience, Hydrological Processes 21:18 (2504-2514), Jan. 2007, 11 pages.

Chen et al., "Distributed acoustic sensor based on two-mode fiber," Optics Express, 26:19, Sep. 17, 2018, 9 pages.

Corona et al., "Novel Washpipe-Free ICD Completion With Dissolvable Material," OTC-28863-MS, Offshore Technology Conference (OTC), presented at the Offshore Technology Conference, April 30-May 3, 2018, 10 pages.

Cox et al., "Realistic Assessment of Proppant Pack Conductivity for Material Section," SPE-84306-MS, Society of Petroleum Engineers (SPE), presented at the SPE Annual Technical Conference and Exhibition, Oct. 5-8, 2003, 12 pages.

Cramer et al., "Development and Application of a Downhole Chemical Injection Pump for Use in ESP Applications," SPE 14403, Society of Petroleum Engineers (SPE), presented at the 66th Annual Technical Conference and Exhibition, Sep. 22-25, 1985, 6 page.

Danfoss, "Facts Worth Knowing about Frequency Converters," Handbook VLT Frequency Converters, Danfoss Engineering Tomorrow, 180 pages.

DiCarlo et al., "Three-phase relative permeability of water-wet, oil-wet, and mixed-wet sandpacks," SPE 60767, Society of Petro-

(56) References Cited

OTHER PUBLICATIONS leum Engineers (SPE), presented at the 1998 SPE Annual Technical Conference and Exhibition, Sep. 27-30, 1998, SPE Journal 5:01 (82-91), Mar. 2000, 10 pages.
Dixit et al., "A pore-level investigation of relative permeability hysteresis in water-wet systems," SPE 37233, Society of Petroleum Engineers (SPE), presented at the 1997 SPE International Symposium on Oilfield Chemistry, Feb. 18-21, 1997, SPE Journal 3:02 (115-123), Jun. 1998, 9 pages.
Drozdov et al., "The Use of Umbilicals as a New Technology of Artificial-Lift Operation of Oil and Gas Wells without Well Killing when Workover," SPE 160689, Society of Petroleum Engineers, presented at the SPE Russian Oil & Gas Exploration & Production Technical Conference and Exhibition in Moscow, Russia, Oct. 16-18, 2012, 8 pages.
ejprescott.com [online], "Water, Sewer and Drain Fittings B-22, Flange Adaptors," retrieved from URL <https://www.ejprescott.com/media/reference/FlangeAdaptorsB-22.pdf> retrieved on Jun. 15, 2020, available on or before Nov. 2010 via wayback machine URL <http://web.archive.org/web/20101128181255/https://www.ejprescott.com/media/reference/FlangeAdaptorsB-22.pdf>, 5 pages.
Fatt, "The network model of porous media," SPE 574-G, I. Capillary Pressure Characteristics, AIME Petroleum Transactions 207: 144-181, Dec. 1956, 38 pages.
Fornarelli et al., "Flow patterns and heat transfer around six in-line circular cylinders at low Reynolds number," JP Journal of Heat and Mass Transfer, Pushpa Publishing House, Allahabad, India, Feb. 2015, 11:1 (1-28), 28 pages.
Geary et al., "Downhole Pressure Boosting in Natural Gas Wells: Results from Prototype Testing," SPE 11406, Society of Petroleum Engineers International (SPE), presented at the SPE Asia Pacific Oil and Gas Conference and Exhibition, Oct. 20-22, 2008, 13 pages.
Gillard et al., "A New Approach to Generating Fracture Conductivity," SPE-135034-MS, Society of Petroleum Engineers (SPE), presented at the SPE Annual Technical Conference and Exhibition, Sep. 20-22, 2010, 14 pages.
Godbole et al., "Axial Thrust in Centrifugal Pumps—Experimental Analysis," Paper Ref: 2977, presented at the 15th International Conference on Experimental Mechanics, ICEM15, Jul. 22-27, 2012, 14 pages.
Gomaa et al., "Computational Fluid Dynamics Applied To Investigate Development and Optimization of Highly Conductive Channels within the Fracture Geometry," SPE-179143-MS, Society of Petroleum Engineers (SPE), SPE Production & Operations, 32:04, Nov. 2017, 12 pages.
Gomaa et al., "Improving Fracture Conductivity by Developing and Optimizing a Channels Within the Fracture Geometry: CFD Study," SPE-178982-MS, Society of Petroleum Engineers (SPE), presented at the SPE International Conference and Exhibition on Formation Damage Control, Feb. 24-26, 2016, 25 pages.
Govardhan et al., "Critical mass in vortex-induced vibration of a cylinder," European Journal of Mechanics B/Fluids, Jan.-Feb. 2004, 23:1 (17-27), 11 pages.
Heiba et al., "Percolation theory of two-phase relative permeability," SPE Reservoir Engineering 7:01 (123-132), Feb. 1992, 11 pages.
Hua et al., "Comparison of Multiphase Pumping Techniques for Subsea and Downhole Applications," SPE 146784, Society of Petroleum Engineers International (SPE), presented at the SPE Annual Technical Conference and Exhibition, Oct. 30-Nov. 2, 2011, Oil and Gas Facilities, Feb. 2012, 11 pages.
Hui and Blunt, "Effects of wettability on three-phase flow in porous media" American Chemical Society (ACS), J. Phys. Chem. 104 :16 (3833-3845), Feb. 2000, 13 pages.
Juarez and Taylor, "Field test of a distributed fiber-optic intrusion sensor system for long perimeters," Applied Optics 46:11, Apr. 10, 2007, 4 pages.
Keiser, "Optical fiber communications," 26-57, McGraw Hill, 2008, 16 pages.
Kern et al., "Propping Fractures With Aluminum Particles," SPE-1573-G-PA, Society of Petroleum Engineers (SPE), Journal of Per. Technology, 13:6 (583-589), Jun. 1961, 7 pages.
Krag et al., "Preventing Scale Deposition Downhole Using High Frequency Electromagnetic AC Signals from Surface Enhance Production Offshore Denmark," SPE-170898-MS, Society of Petroleum Engineers International (SPE), presented at the SPE Annual Technical Conference and Exhibition, Oct. 27-29, 2014, 10 pages.
laserfocusworld.com [online], "High-Power Lasers: Fiber lasers drill for oil," Dec. 5, 2012, retrieved on May 31, 2018, retrieved from URL: <https://www.laserfocusworld.com/articles/print/volume-48/issue-12/world-news/high-power-lasers-fiber-lasers-drill-for-oil.html>, 4 pages.
Li et al., "In Situ Estimation of Relative Permeability from Resistivity Measurements," EAGE/The Geological Society of London, Petroleum Geoscience 20: 143-151, 2014, 10 pages.
machinedesign.com [online], Frances Richards, "Motors for efficiency: Permanent-magnet, reluctance, and induction motors compared," Apr. 2013, retrieved on Nov. 11, 2020, retrieved from URL <https://www.machinedesign.com/motors-drives/article/21832406/motors-for-efficiency-permanentmagnet-reluctance-and-induction-motors-compared>.
Mahmud et al., "Effect of network topology on two-phase imbibition relative permeability," Transport in Porous Media 66:3 (481-493), Feb. 2007, 14 pages.
Meyer et al., "Theoretical Foundation and Design Formulae for Channel and Pillar Type Propped Fractures—A Method to Increase Fracture Conductivity," SPE-170781-MS, Society of Petroleum Engineers (SPE), presented at the SPE Annual Technical Conference and Exhibition, Oct. 27-29, 2014, 25 pages.
Mirza, "The Next Generation of Progressive Cavity Multiphase Pumps use a Novel Design Concept for Superior Performance and Wet Gas Compression," Flow Loop Testing, BHR Group, 2007, 9 pages.
Mirza, "Three Generations of Multiphase Progressive Cavity Pumping," Cahaba Media Group, Upstream Pumping Solutions, Winter 2012, 6 pages.
Muswar et al., "Physical Water Treatment in the Oil Field Results from Indonesia," SPE 113526, Society of Petroleum Engineers International (SPE), presented at the SPE Asia Pacific Oil and Gas Conference and Exhibition, Oct. 18-20, 2010, 11 pages.
Nagy et al., "Comparison of permeability testing methods," Proceedings of the 18th International Conference on Soil Mechanics and Geotechnical Engineering 399-402, 2013, 4 pages.
Palisch et al., "Determining Realistic Fracture Conductivity and Understanding its Impact on Well Performance—Theory and Field Examples," SPE-106301-MS, Society of Petroleum Engineers (SPE), presented at the 2007 SPE Hydraulic Fracturing Technology Conference, Jan. 29-31, 2007, 13 pages.
Parker, "About Gerotors," Parker Haffinfin Corp, 2008, 2 pages.
Poollen et al., "Hydraulic Fracturing—FractureFlow Capacity vs Well Productivity," SPE-890-G, Society of Petroleum Engineers (SPE), presented at 32nd Annual Fall Meeting of Society of Petroleum Engineers, Oct. 6-9, 1957, published as Petroleum Transactions AIME 213, 1958, 5 pages.
Poollen, "Productivity vs Permeability Damage in Hydraulically Produced Fractures," Paper 906-2-G, American Petroleum Institute, presented at Drilling and Production Practice, Jan. 1, 1957, 8 pages.
Purcell, "Capillary pressures—their measurement using mercury and the calculation of permeability therefrom," Petroleum Transactions, AIME, presented at the Branch Fall Meeting, Oct. 4-6, 1948, Journal of Petroleum Technology 1:02 (39-48), Feb. 1949, 10 pages.
Qin et al., "Signal-to-Noise Ratio Enhancement Based on Empirical Mode Decomposition in Phase-Sensitive Optical Time Domain Reflectometry Systems," Sensors, MDPI, 17:1870, Aug. 14, 2017, 10 pages.
Qin Guozhi et al., "Anti-corrosion Coating Technology and Equipment Application Manual", Sinopec Press, Jun. 30, 2004, pp. 257, 19 pages, English Abstract only.
Rzeznik et al., "Two Year Results of a Breakthrough Physical Water Treating System for the Control of Scale in Oilfield Applications,"

(56) References Cited

OTHER PUBLICATIONS

SPE114072, Society of Petroleum Engineers International (SPE), presented at the 2008 SPE International Oilfield Scale Conference, May 28-29, 2008, 11 pages.
Schlumberger, "AGH: Advanced Gas-Handling Device," Product Sheet, retrieved from URL: <http://www.slb.com/~/media/Files/artificial_lift/product_sheets/ESPs/advanced_gas_handling_ps.pdf>, Jan. 2014, 2 pages.
Schöneberg, "Wet Gas Compression with Twin Screw Pumps," Bornemann Pumps, Calgary Pump Symposium 2005, 50 pages.
Simpson et al., "A Touch, Truly Multiphase Downhole Pump for Unconventional Wells," SPE-185152-MS, Society of Petroleum Engineers (SPE), presented at the SPE Electric Submersible Pump Symposium, the Woodlands, Texas, Apr. 24-28, 2017, 20 pages.
Sulzer Technical Review, "Pushing the Boundaries of Centrifugal Pump Design," Oil and Gas, Jan. 2014, 2 pages.
Takahashi et al., "Degradation Study on Materials for Dissolvable Frac Plugs," URTEC-2901283-MS, Unconventional Resources Technology Conference (URTC), presented at the SPE/AAPG/SEG Unconventional Resources Technology Conference, Jul. 23-25, 2018, 9 pages.
Tinsley and Williams, "A new method for providing increased fracture conductivity and improving stimulation results," SPE-4676-PA, Society of Petroleum Engineers (SPE), Journal of Petroleum Technology, 27:11, Nov. 1975, 7 pages.
tm4.com [online], "Outer rotor for greater performance," available on or before Dec. 5, 2017, via internet archive: Wayback Machine URL <https://web.archive.org/web/20171205163856/https://www.tm4.com/technology/electric-motors/external-rotor-motor-technology/>, retrieved on May 17, 2017, retrieved from URL <https://www.tm4.com/technology/electric-motors/external-rotor-motor-technology/>, 2 pages.
Vincent, "Examining Our Assumptions—Have Oversimplifications Jeopardized our Ability To Design Optimal Fracture Treatments," SPE-119143-MS, Society of Petroleum Engineers (SPE), presented at the 2009 SPE Hydraulic Fracturing Technology Conference, Jan. 19-21, 2009, 51 pages.
Vincent, "Five Things You Didn't Want to Know about Hydraulic Fractures," ISRM-ICHF-2013-045, presented at the International Conference for Effective and Sustainable Hydraulic Fracturing: An ISRM specialized Conference, May 20-22, 2013, 14 pages.
Vysloukh, "Chapter 8: Stimulated Raman Scattering," 298-302, in Nonlinear Fiber Optics, 1990, 5 pages.
Walker et al., "Proppants, We Don't Need No Proppants—A Perspective of Several Operators," SPE-38611-MS, Society of Petroleum Engineers (SPE), presented at the 1997 Annual Technical Conference and Exhibition, Oct. 5-8, 1997, 8 pages.
Wang Bing et al., "Wellbore Scaling and Descaling Research," Oil Field Equipment, Nov. 2007, 36(11): 17-21, English Abstract.
Wang et al., "Rayleigh scattering in few-mode optical fibers," Scientific reports, 6:35844, Oct. 2016, 8 pages.
Wylde et al., "Deep Downhole Chemical Injection on BP-Operated Miller: Experience and Learning," SPE 92832, Society of Petroleum Engineers (SPE), presented at the 2005 SPE International Symposium on Oilfield Chemistry, May 11-12, 2005, SPE Production & Operations, May 2006, 6 pages.
Xiao et al., "Induction Versus Permanent Magnet Motors for ESP Applications," SPE-192177-MS, Society of Petroleum Engineers (SPE), presented at the SPE Kingdom of Saudi Arabia Annual Technical Symposium and Exhibition, Apr. 23-26, 2018, 15 pages.
Yamate et al., "Optical Sensors for the Exploration of Oil and Gas," Journal of Lightwave Technology 35:16, Aug. 15, 2017, 8 pages.
Yu et al., "Borehole seismic survey using multimode optical fibers in a hybrid wireline," Measurement, Sep. 2018, 125:694-703, 10 pages.
Zhan et al., "Characterization of Reservoir Heterogeneity Through Fluid Movement Monitoring with Deep Electromagnetic and Pressure Measurements," SPE 116328, Society of Petroleum Engineers International (SPE), presented at the 2008 SPE Annual Technical Conference and Exhibition, Sep. 21-24, 2008, 16 pages.

* cited by examiner

300

DOWNHOLE PHASE SEPARATION IN DEVIATED WELLS

TECHNICAL FIELD

This disclosure relates to downhole phase separation in subterranean formations, and in particular, in deviated wells.

BACKGROUND

Gas reservoirs that have naturally low reservoir pressures can be susceptible to liquid loading at some point in the production life of a well due to the reservoir's inability to provide sufficient pressure to carry wellbore liquids to the surface. As liquids accumulate, slug flow of gas and liquid phases can be encountered, especially in deviated wells. As a deviated well turns vertically at a heel, gas can segregate and migrate upward in comparison to liquid due to the effects of gravity and collect to form gas slugs. Slug flows are unstable and can bring solids issues and pumping interferences, which can result in an increase in operating expenses, excessive workover costs, and insufficient pressure drawdown.

SUMMARY

This disclosure describes technologies relating to downhole phase separation in subterranean formations, and in particular, in deviated wells. Certain aspects of the subject matter described can be implemented as a system. The system includes a packer, a first tubular, a second tubular, and a connector. The packer is configured to be disposed in a deviated portion of a well formed in a subterranean formation. The packer is configured to form a seal with an inner wall of the well. The first tubular extends through the packer and has a cross-sectional flow area that is smaller than a cross-sectional flow area of the well. The first tubular includes a first inlet and a first outlet portion. The first inlet is configured to receive a wellbore fluid. The first outlet portion is configured to induce separation of a gaseous portion of the wellbore fluid from a remainder of the wellbore fluid, such that the gaseous portion flows uphole through an annulus between the inner wall of the well and the first tubular. The second tubular includes a second inlet and a second outlet. The second inlet is configured to receive at least a liquid portion of the remainder of the wellbore fluid. The second outlet is configured to discharge the liquid portion of the remainder of the wellbore fluid. The connector is coupled to the first tubular and the second tubular. The connector is coupled to the first outlet portion of the first tubular, such that the connector is configured to prevent flow of the wellbore fluid from the first tubular through the connector. The connector is configured to fluidically connect the second tubular to a downhole artificial lift system disposed within the well, uphole of the connector. A sump for accumulation of solid material from the wellbore fluid is defined by a region of the annulus between the inner wall of the well and the first tubular, downhole of the second inlet of the second tubular and uphole of the packer.

This, and other aspects, can include one or more of the following features. The deviated portion of the well in which the packer is disposed can have a deviation angle in a range of from 70 degrees (°) to 90° (horizontal). The first tubular can include a first portion near the first inlet. The first portion can have a first deviation angle. The first outlet portion can have a second deviation angle that is less than the first deviation angle. The first outlet portion of the first tubular can define perforations. The perforations can be configured to induce separation of the gaseous portion of the wellbore fluid from the remainder of the wellbore fluid as the wellbore fluid flows through the perforations. The second tubular can have a cross-sectional flow area that is smaller than the cross-sectional flow area of the first tubular. The first tubular can extend past the packer. The first inlet can be positioned downhole in comparison to the packer.

Certain aspects of the subject matter described can be implemented as a system. The system includes a packer, a first tubular, and a second tubular. The packer is configured to be disposed in a deviated portion of a well formed in a subterranean formation. The packer is configured to form a seal with an inner wall of the well. The first tubular extends through the packer. The first tubular has a cross-sectional flow area that is smaller than a cross-sectional flow area of the well. The first tubular includes a first inlet and a first outlet. The first inlet is configured to receive a wellbore fluid. The first outlet is configured to discharge the wellbore fluid into an annulus within the well, uphole of the packer. The second tubular is coupled to the first tubular. The second tubular includes a second inlet and a second outlet. The second inlet is configured to receive at least a liquid portion of the wellbore fluid. The second outlet is configured to discharge the liquid portion of the wellbore fluid to a downhole artificial lift system disposed within the well. The first tubular and the second tubular share a common wall that defines a divided section. The first outlet of the first tubular is disposed at an uphole end of the divided section. The second inlet of the second tubular is disposed at a downhole end of the divided section. A sump for accumulation of solid material from the wellbore fluid is defined by a region of an annulus between the inner wall of the well and the first tubular, downhole of the second inlet of the second tubular and uphole of the packer.

This, and other aspects, can include one or more of the following features. The deviated portion of the well in which the packer is disposed can have a deviation angle in a range of from 70 degrees (°) to 90° (horizontal). The first tubular can include a first portion near the first inlet. The first portion can have a first deviation angle. The first tubular can include a second portion near the first outlet. The second portion can have a second deviation angle less than the first deviation angle. The second tubular can have a cross-sectional flow area that is smaller than the cross-sectional flow area of the first tubular. The first tubular can extend past the packer. The first inlet can be positioned downhole in comparison to the packer.

Certain aspects of the subject matter described can be implemented as a method. A packer is disposed in a deviated portion of a well formed in a subterranean formation. The packer seals with an inner wall of the well. A first tubular extends through the packer. The first tubular has a cross-sectional flow area that is smaller than a cross-sectional flow area of the well. The first tubular includes a first inlet and a first outlet. The first tubular receives a wellbore fluid via the first inlet. The first outlet discharges the wellbore fluid into an annulus within the well, uphole of the packer. A second tubular is coupled to the first tubular. The second tubular includes a second inlet. The second tubular receives at least a liquid portion of the wellbore fluid via the second inlet. The second tubular directs the liquid portion of the wellbore fluid to a downhole artificial lift system disposed within the well. A sump is defined by a region of an annulus between the inner wall of the well and the first tubular, downhole of the second inlet of the second tubular and uphole of the packer. The sump receives at least a portion of solid material carried by the wellbore fluid.

This, and other aspects, can include one or more of the following features. The deviated portion of the well in which the packer is disposed can have a deviation angle in a range of from 70 degrees (°) to 90° (horizontal). The first tubular can include a first portion near the first inlet. The first portion can have a first deviation angle. The first tubular can include a second portion near the first outlet. The second portion can have a second deviation angle that is less than the first deviation angle. The second tubular can have a cross-sectional flow area that is smaller than the cross-sectional flow area of the first tubular. The first tubular can extend past the packer. The first inlet can be positioned downhole in comparison to the packer. The first tubular and the second tubular can share a common wall that defines a divided section. The first outlet of the first tubular can be disposed at an uphole end of the divided section. The second inlet of the second tubular can be disposed at a downhole end of the divided section. Fluid flowing from the first tubular to the second tubular can flow into the annulus before entering the second tubular. The first tubular and the second tubular can be coupled by a connector. The connector can prevent the wellbore fluid from flowing from the first tubular and through the connector. The connector can fluidically connect the second tubular to the downhole artificial lift system. The first tubular can include multiple outlets. The first outlet can be one of the outlets. The multiple outlets of the first tubular can induce separation of a gaseous portion of the wellbore fluid from a remainder of the wellbore fluid as the wellbore fluid flows out of the first tubular through the multiple outlets.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

A phase separation system includes a seal that seals against a wall of a wellbore. A first tubular extends through the seal. The first tubular includes an inlet downhole of the packer that receives a wellbore fluid. The first tubular includes an outlet uphole of the packer that discharges the wellbore fluid into an annulus between the first tubular and the wall of the wellbore, uphole of the packer. A gaseous portion of the wellbore fluid separates from a remainder of the wellbore fluid and flows uphole through the annulus to the surface. The first tubular is coupled to a second tubular. The second tubular includes an inlet downhole of the outlet of the first tubular and uphole of the packer. The inlet of the second tubular receives at least a liquid portion of the wellbore fluid discharged by the first tubular. The second tubular includes an outlet uphole of the inlet of the second tubular that discharges the liquid portion of the wellbore fluid. The liquid portion of the wellbore fluid discharged by the second tubular flows to a downhole artificial lift system to be produced to the surface. A sump is defined by a region of the annulus downhole of the inlet of the second tubular and uphole of the packer. The sump can accumulate solid material carried by the wellbore fluid.

The subject matter described in this disclosure can be implemented in particular implementations, so as to realize one or more of the following advantages. The phase separation systems described herein can effectively mitigate and/or eliminate downhole slugging issues in wells, and in particular, in deviated wells. The phase separation systems described herein can mitigate and/or eliminate liquid loading issues in wells, and in particular, in deviated wells. The phase separation systems described herein can reduce a cross-sectional flow area of multi-phase wellbore fluids in comparison to a cross-sectional flow area of an annulus of a well for gas flow, which can facilitate downhole gas-liquid separation and also mitigate and/or eliminate gas carry-under and liquid carry-over in wells, and in particular, in deviated wells. The phase separation systems described herein can reduce costs associated with well completion operations.

Figure 1:
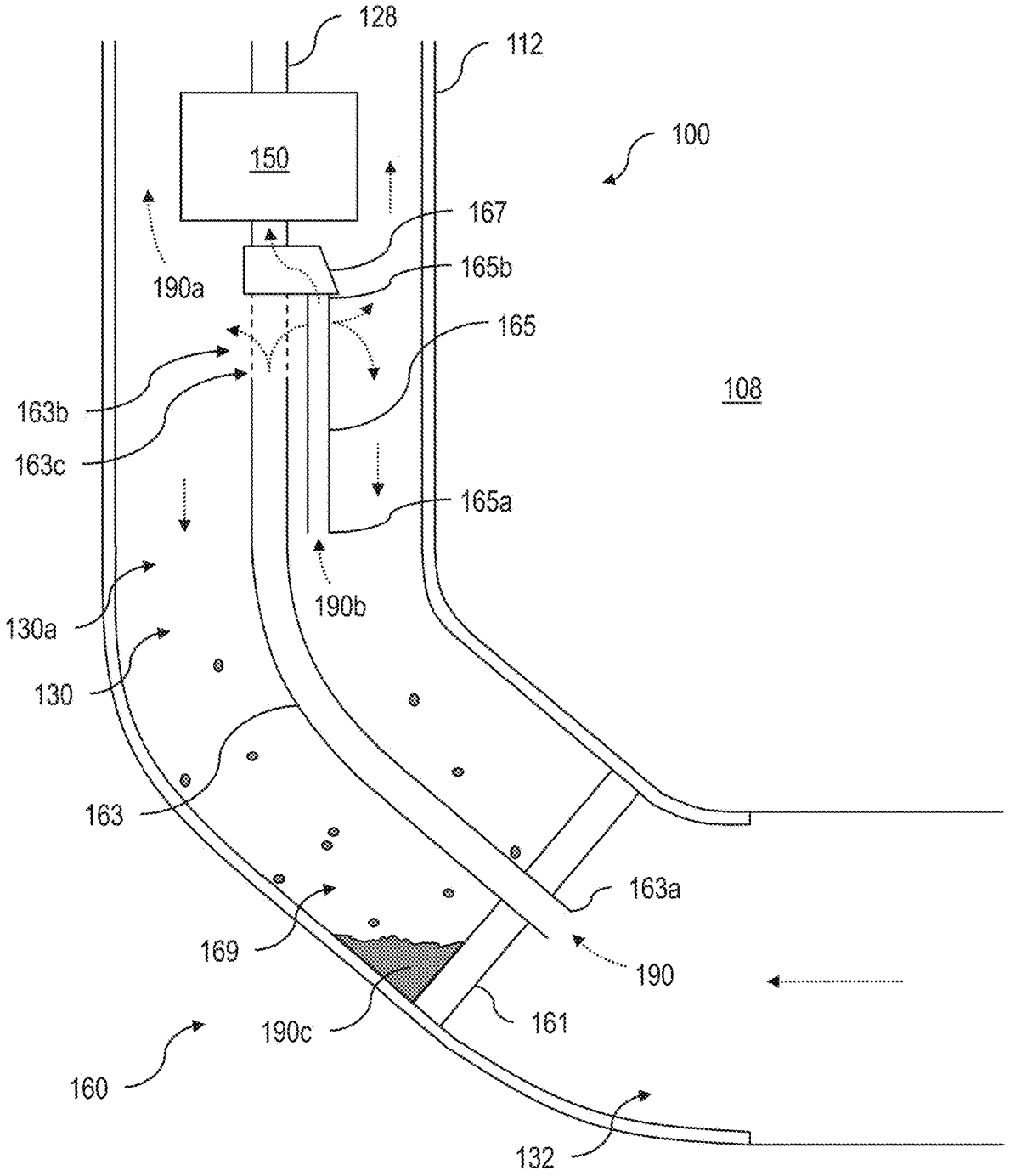
FIG. 1 is a schematic diagram of an example phase separator implemented in a well.

FIG. 1 depicts an example well 100 constructed in accordance with the concepts herein. The well 100 extends from the surface through the Earth 108 to one more subterranean zones of interest. The well 100 enables access to the subterranean zones of interest to allow recovery (that is, production) of fluids to the surface and, in some implementations, additionally or alternatively allows fluids to be placed in the Earth 108. In some implementations, the subterranean zone is a formation within the Earth 108 defining a reservoir, but in other instances, the zone can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. The well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest to the surface. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest to the surface. While termed an "oil well," the well not need produce only hydrocarbon liquid, and may incidentally or in much smaller quantities, produce gas, water, or both. The production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone.

The wellbore of the well 100 is typically, although not necessarily, cylindrical. All or a portion of the wellbore is lined with a tubing, such as casing 112. The casing 112 connects with a wellhead at the surface and extends downhole into the wellbore. The casing 112 operates to isolate the bore of the well 100, defined in the cased portion of the well 100 by the inner bore of the casing 112, from the surrounding Earth 108. The casing 112 can be formed of a single continuous tubing or multiple lengths of tubing joined (for example, threadedly) end-to-end. The casing 112 can be perforated in the subterranean zone of interest to allow fluid communication between the subterranean zone of interest and the bore of the casing 112. In some implementations, the casing 112 is omitted or ceases in the region of the subterranean zone of interest. This portion of the well 100 without casing is often referred to as "open hole."

The wellhead defines an attachment point for other equipment to be attached to the well 100. For example, the well 100 can be produced with a Christmas tree attached to the wellhead. The Christmas tree can include valves used to regulate flow into or out of the well 100. The well 100 includes a downhole artificial lift system 150 residing in the wellbore, for example, at a depth that is nearer to subterranean zone than the surface. The artificial lift system 150, being of a type configured in size and robust construction for installation within a well 100, can include any type of rotating equipment that can assist production of fluids to the surface and out of the well 100 by creating an additional pressure differential within the well 100. For example, the artificial lift system 150 can include a pump, compressor, blower, or multi-phase fluid flow aid.

In particular, casing 112 is commercially produced in a number of common sizes specified by the American Petroleum Institute (the "API"), including 4½, 5, 5½, 6, 6⅝, 7, 7⅝, 7¾, 8⅝, 8¾, 9⅝, 9¾, 9⅞, 10¾, 11¾, 11⅞, 13⅜, 13½, 13⅝, 16, 18⅝, and 20 inches, and the API specifies internal diameters for each casing size. The artificial lift system 150 can be configured to fit in, and (as discussed in more detail below) in certain instances, seal to the inner diameter of one of the specified API casing sizes. Of course, the artificial lift system 150 can be made to fit in and, in certain instances, seal to other sizes of casing or tubing or otherwise seal to a wall of the well 100.

Additionally, the construction of the components of the artificial lift system 150 are configured to withstand the impacts, scraping, and other physical challenges the artificial lift system 150 will encounter while being passed hundreds of feet/meters or even multiple miles/kilometers into and out of the well 100. For example, the artificial lift system 150 can be disposed in the well 100 at a depth of up to 10,000 feet (3,048 meters). Beyond just a rugged exterior, this encompasses having certain portions of any electronics being ruggedized to be shock resistant and remain fluid tight during such physical challenges and during operation. Additionally, the artificial lift system 150 is configured to withstand and operate for extended periods of time (for example, multiple weeks, months or years) at the pressures and temperatures experienced in the well 100, which temperatures can exceed 400 degrees Fahrenheit (° F.)/205 degrees Celsius (° C.) and pressures over 2,000 pounds per square inch gauge (psig), and while submerged in the well fluids (gas, water, or oil as examples). Finally, the artificial lift system 150 can be configured to interface with one or more of the common deployment systems, such as jointed tubing (that is, lengths of tubing joined end-to-end), a sucker rod, coiled tubing (that is, not-jointed tubing, but rather a continuous, unbroken and flexible tubing formed as a single piece of material), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector).

FIG. 1 shows the artificial lift system 150 positioned in the open volume of the bore of the casing 112, and connected to a production string of tubing (also referred as production tubing 128) in the well 100. The wall of the well 100 includes the interior wall of the casing 112 in portions of the wellbore having the casing 112, and includes the open hole wellbore wall in uncased portions of the well 100.

In some implementations, the artificial lift system 150 can be implemented to alter characteristics of a wellbore by a mechanical intervention at the source. Alternatively, or in addition to any of the other implementations described in this specification, the artificial lift system 150 can be implemented as a high flow, low pressure rotary device for gas flow. Alternatively, or in addition to any of the other implementations described in this specification, the artificial lift system 150 can be implemented in a direct well-casing deployment for production through the wellbore. Other implementations of the artificial lift system 150 as a pump, compressor, or multiphase combination of these can be utilized in the well bore to effect increased well production.

The artificial lift system 150 locally alters the pressure, temperature, flow rate conditions, or a combination of these of the fluid in the well 100 proximate the artificial lift system 150. In certain instances, the alteration performed by the artificial lift system 150 can optimize or help in optimizing fluid flow through the well 100. As described previously, the artificial lift system 150 creates a pressure differential within the well 100, for example, particularly within the locale in which the artificial lift system 150 resides. In some instances, a pressure at the base of the well 100 is a low pressure, so unassisted fluid flow in the wellbore can be slow or stagnant. In these and other instances, the artificial lift system 150 introduced to the well 100 adjacent the perforations can reduce the pressure in the well 100 near the perforations to induce greater fluid flow from the subterranean zone, increase a temperature of the fluid entering the artificial lift system 150 to reduce condensation from limiting production, increase a pressure in the well 100 uphole of the artificial lift system 150 to increase fluid flow to the surface, or a combination of these.

The artificial lift system 150 moves the fluid at a first pressure downhole of the artificial lift system 150 to a second, higher pressure uphole of the artificial lift system 150. The artificial lift system 150 can operate at and maintain a pressure ratio across the artificial lift system 150 between the second, higher uphole pressure and the first, downhole pressure in the wellbore. The pressure ratio of the second pressure to the first pressure can also vary, for example, based on an operating speed of the artificial lift system 150. The artificial lift system 150 can operate in a variety of downhole conditions of the well 100. For example, the initial pressure within the well 100 can vary based on the type of well, depth of the well 100, and production flow from the perforations into the well 100.

The well 100 includes a phase separation system 160. The phase separation system 160 includes a seal 161 integrated or provided separately with a downhole system, as shown with the artificial lift system 150. The seal 161 divides the well 100 into an uphole zone 130 above the seal 161 and a downhole zone 132 below the seal 161. The seal 161 is configured to seal against the wall of the wellbore, for example, against the interior wall of the casing 112 in the cased portions of the well 100 or against the interior wall of the wellbore in the uncased, open hole portions of the well 100. In certain instances, the seal 161 can form a gas- and liquid-tight seal at the pressure differential the artificial lift system 150 creates in the well 100. For example, the seal 161 can be configured to at least partially seal against an interior wall of the wellbore to separate (completely or substantially) a pressure in the well 100 downhole of the seal 161 from a pressure in the well 100 uphole of the seal 161. Although not shown in FIG. 1, additional components, such as a surface compressor, can be used in conjunction with the artificial lift system 150 to boost pressure in the well 100. The seal 161 can be, for example, a packer. The seal 161 is configured to be disposed in a deviated portion of the well 100. In some implementations, the deviated portion of the well 100 in which the seal 161 is disposed has a deviation angle in a range of from 70 degrees (°) to 90° (horizontal).

The phase separation system 160 includes a first tubular 163, a second tubular 165, and a connector 167. The first tubular 163 extends through the seal 161. The first tubular 163 includes an inlet 163*a* configured to receive a wellbore fluid 190. The first tubular 163 has a cross-sectional flow area that is smaller than a cross-sectional flow area of the well 100 (for example, the wellbore). The wellbore fluid 190 entering the first tubular 163 via the inlet 163*a* accelerates due to the decreased cross-sectional flow area. The first tubular 163 includes an outlet portion 163*b* that is configured to induce separation of a gaseous portion 190*a* of the wellbore fluid 190 from a remainder of the wellbore fluid 190 (for example, a liquid portion 190*b* of the wellbore fluid and solid material 190*c* carried by the wellbore fluid). In some implementations, the outlet portion 163*b* defines perforations 163*c*, and the perforations 163*c* are configured to induce separation of the gaseous portion 190*a* of the wellbore fluid 190 from the remainder of the wellbore fluid 190 as the wellbore fluid 190 flows through the perforations 163*c*. For example, the perforations 163*c* can induce a "bubbling" effect that enhances separation of the gaseous portion 190*a* of the wellbore fluid 190 from the remainder of the wellbore fluid 190. In some implementations, the first tubular 163 includes a swirl device (not shown), such as helical vanes disposed within the outlet portion 163*b* of the first tubular 163, which can induce rotation in the wellbore fluid 190 flowing through the first tubular 163. The rotation of the wellbore fluid 190 induced by the swirl device can enhance phase separation via centrifugal force.

The gaseous portion 190*a* of the wellbore fluid 190 can then flow uphole through an annulus 130*a* of the uphole zone 130 between the inner wall of the well 100 (for example, the casing 112) and the first tubular 163. In some implementations, as shown in FIG. 1, the outlet portion 163*b* has a deviation angle that is less than a deviation angle of an inlet portion of the first tubular 163 near the inlet 163*a*. In some implementations, the inlet portion of the first tubular 163 near the inlet 163*a* has a deviation angle in a range of from 70° to 90° (horizontal). In some implementations, the inlet portion of the first tubular 163 near the inlet 163*a* has a deviation angle that is the same as the deviation angle of the deviated portion of the well 100 in which the seal 161 is disposed. In some implementations, the outlet portion 163*b* of the first tubular 163 has a deviation angle in a range of from 0° (vertical) to 30°. In some implementations, as shown in FIG. 1, the first tubular 163 extends past the seal 161, such that the inlet 163*a* of the first tubular 163 is positioned downhole in comparison to the seal 161.

The second tubular 165 includes an inlet 165*a* configured to receive at least a liquid portion 190*b* of the wellbore fluid 190. The second tubular 165 includes an outlet 165*b* configured to discharge the liquid portion 190*b* of the wellbore fluid 190. The liquid portion 190*b* of the wellbore fluid 190 discharged by the outlet 165*b* of the second tubular 165 flows to the artificial lift system 150 to be produced to the surface. In some implementations, the second tubular 165 has a cross-sectional flow area that is smaller than the cross-sectional flow area of the first tubular 163. Decreasing the cross-sectional flow areas of the first tubular 163 and the second tubular 165 directly increases the cross-sectional flow area of the annulus 130*a* of the uphole zone 130, which can facilitate the separation of phases (gas from liquid and solid from liquid) of the wellbore fluid 190. In some implementations, the inlet 165*a* of the second tubular 165 includes a screen (not shown) that is configured to prevent solid material of a certain size from flowing through the screen and into the second tubular 165 via the inlet 165*a*. The screen can be sized to prevent sand or other particulate matter that is expected to be produced with the production fluid (for example, identified from production data obtained for the well 100) from flowing through the screen and into the second tubular 165 via the inlet 165*a*.

The connector 167 is coupled to the first tubular 163 and the second tubular 165. The connector 167 is coupled to the outlet portion 163*b* of the first tubular 163, such that the connector 167 is configured to prevent flow of the wellbore fluid 190 from the first tubular 163 through the connector 167. That is, any fluid that flows into the first tubular 163 via the inlet 163*a* flows out of the first tubular 163 through the perforations 163*c* of the outlet portion 163*b* instead of flowing through the connector 167. The connector 167 is configured to fluidically connect the second tubular 165 to the artificial lift system 150, which is disposed uphole of the connector 167.

A sump 169 of the phase separation system 160 is defined by a region of the annulus 130*a* of the uphole zone 130 between the inner wall of the well 100 (for example, the casing 112) and the first tubular 163, downhole of the inlet 165*a* of the second tubular 165 and uphole of the seal 161. The sump 169 can accumulate the solid material 190*c* carried by the wellbore fluid 190. For example, the solid material 190*c* carried by the wellbore fluid 190 can flow into the first tubular 163 via the inlet 163*a*, out of the first tubular 163 via the outlet portion 163*b*, and settle in the sump 169 due to gravity. The perforations 163*c* of the outlet portion 163*b* of the first tubular 163 can be sized, such that the solid material 190*c* can pass through the perforations 163*c* without getting lodged/stuck in the perforations 163*c*. The perforations 163*c* can be sized to allow sand or other particulate matter (for example, identified from production data obtained for the well 100) to pass through the perforations 163*c* without getting lodged/stuck in the perforations 163*c*, so that the sand or other particulate matter can be discharged to the annulus 130*a* of the uphole zone 130 between the inner wall of the well 100 (for example, the casing 112) and the first tubular 163 and subsequently settle in the sump 169. The perforations 163*c* of the outlet portion 163*b* of the first tubular 163 can have any shape, for example, circular or any other geometric shape.

Figure 2:
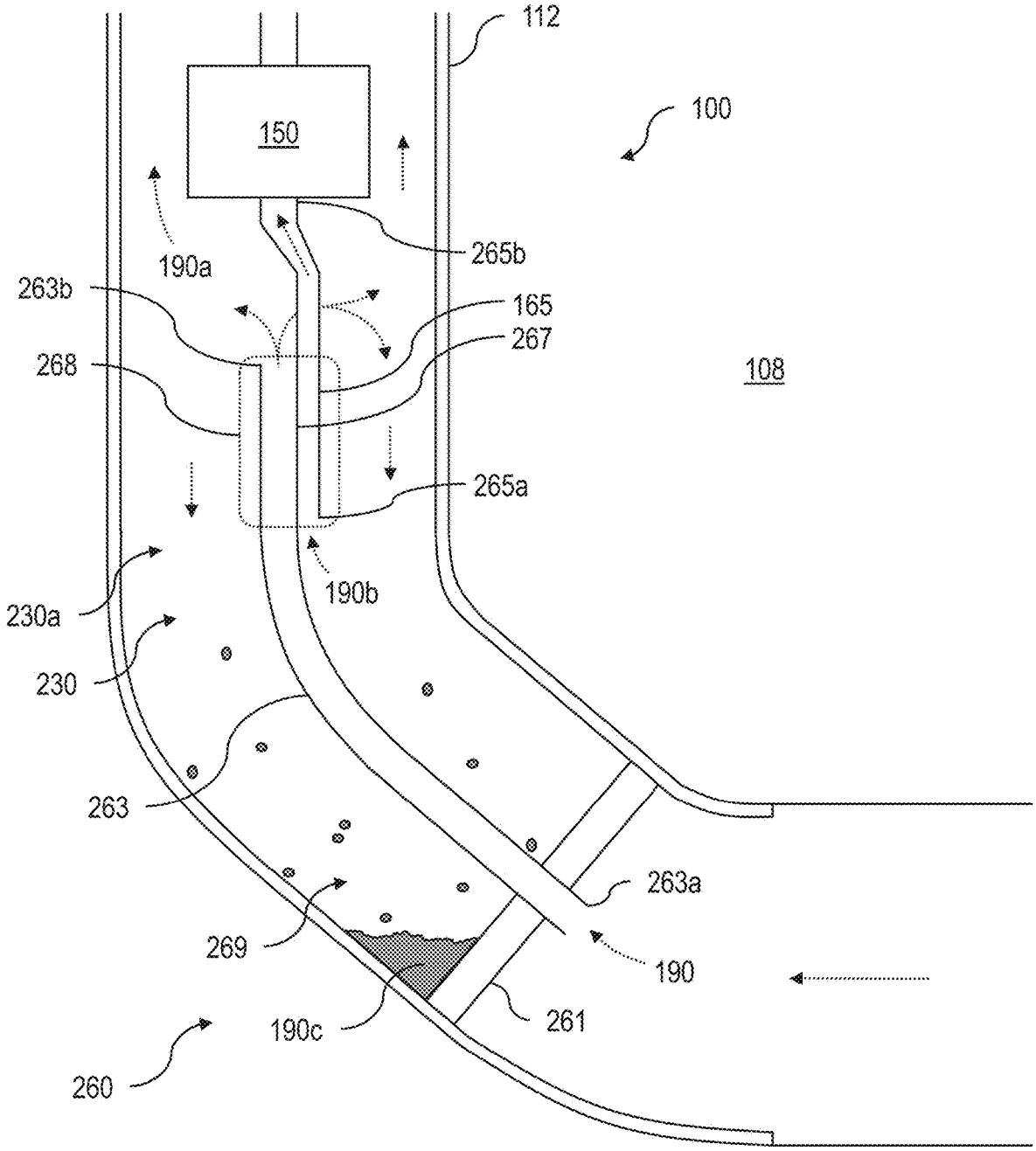
FIG. 2 is a schematic diagram of an example phase separator implemented in a well.

FIG. 2 depicts an example phase separation system 260 implemented in the well 100. The phase separation system 260 can be substantially similar to the phase separation system 160 shown in FIG. 1. For example, the phase separation system 260 includes a seal 261, and the seal 261 can be substantially the same as the seal 161 of the phase separation system 160 shown in FIG. 1. The seal 261 can be, for example, a packer. The seal 261 is configured to be disposed in a deviated portion of the well 100. In some implementations, the deviated portion of the well 100 in which the seal 261 is disposed has a deviation angle in a range of from 70° to 90° (horizontal).

The phase separation system 260 includes a first tubular 263 and a second tubular 265. The first tubular 263 can be substantially similar to the first tubular 163 of the phase separation system 160 shown in FIG. 1. The first tubular 263 extends through the seal 261. The first tubular 263 includes an inlet 263*a* configured to receive a wellbore fluid 190. The first tubular 263 has a cross-sectional flow area that is smaller than a cross-sectional flow area of the well 100 (for example, the wellbore). The wellbore fluid 190 entering the first tubular 263 via the inlet 263*a* accelerates due to the decreased cross-sectional flow area. The first tubular 263 includes an outlet 263*b* that is configured to discharge the wellbore fluid 190 into the annulus 230*a* of the uphole zone 230 within the well 100. In some implementations, the first tubular 263 defines perforations (similar to the outlet portion 163*b* of the first tubular 163), and the perforations are configured to induce separation of the gaseous portion 190*a* of the wellbore fluid 190 from the remainder of the wellbore fluid 190 as the wellbore fluid 190 flows through the perforations. In some implementations, the first tubular 263 includes a swirl device (not shown), such as helical vanes disposed within the first tubular 263, which can induce rotation in the wellbore fluid 190 flowing through the first tubular 263. The rotation of the wellbore fluid 190 induced by the swirl device can enhance phase separation via centrifugal force.

The gaseous portion 190*a* of the wellbore fluid 190 can then flow uphole through the annulus 230*a* of the uphole zone 230 between the inner wall of the well 100 (for example, the casing 112) and the first tubular 263. In some implementations, as shown in FIG. 2, an outlet portion of the first tubular 263 near the outlet 263*b* has a deviation angle that is less than a deviation angle of an inlet portion of the first tubular 263 near the inlet 263*a*. In some implementations, the inlet portion of the first tubular 263 near the inlet 263*a* has a deviation angle in a range of from 70° to 90° (horizontal). In some implementations, the inlet portion of the first tubular 263 near the inlet 263*a* has a deviation angle that is the same as the deviation angle of the deviated portion of the well 100 in which the seal 261 is disposed. In some implementations, the outlet portion of the first tubular 263 has a deviation angle in a range of from 0° (vertical) to 30°. In some implementations, as shown in FIG. 2, the first tubular 263 extends past the seal 261, such that the inlet 263*a* of the first tubular 263 is positioned downhole in comparison to the seal 261.

The second tubular 265 can be substantially similar to the second tubular 165 of the phase separation system 160 shown in FIG. 1. The second tubular 265 includes an inlet 265*a* configured to receive at least a liquid portion 190*b* of the wellbore fluid 190. The second tubular 265 includes an outlet 265*b* configured to discharge the liquid portion 190*b* of the wellbore fluid 190. The liquid portion 190*b* of the wellbore fluid 190 discharged by the outlet 265*b* of the second tubular 265 flows to the artificial lift system 150 to be produced to the surface. In some implementations, the second tubular 265 has a cross-sectional flow area that is smaller than the cross-sectional flow area of the first tubular 263. Decreasing the cross-sectional flow areas of the first tubular 263 and the second tubular 265 directly increases the cross-sectional flow area of the annulus 230*a* of the uphole zone 230, which can facilitate the separation of phases (gas from liquid and solid from liquid) of the wellbore fluid 190. In some implementations, the inlet 265*a* of the second tubular 265 includes a screen (not shown) that is configured to prevent solid material of a certain size from flowing through the screen and into the second tubular 265 via the inlet 265*a*. The screen can be sized to prevent sand or other particulate matter that is expected to be produced with the production fluid (for example, identified from production data obtained for the well 100) from flowing through the screen and into the second tubular 265 via the inlet 265*a*.

The second tubular 265 is coupled to the first tubular 263. The first tubular 263 and the second tubular 265 share a common wall 267 that defines a divided section 268. The outlet 263*b* of the first tubular 263 is disposed at an uphole end of the divided section 268. The inlet 265*a* of the second tubular 265 is disposed at a downhole end of the divided section 268. Thus, the divided section 268 ensures that fluid flowing from the first tubular 263 to the second tubular 265 (for example, the liquid portion 190*b* of the wellbore fluid 190) flows out of the first tubular 263 via the outlet 263*b* and into the annulus 230*a* before entering the second tubular 265 via the inlet 265*a*.

A sump 269 of the phase separation system 260 is defined by a region of the annulus 230*a* of the uphole zone 230 between the inner wall of the well 100 (for example, the casing 112) and the first tubular 263, downhole of the inlet 265*a* of the second tubular 265 and uphole of the seal 261. The sump 269 can be substantially similar to the sump 169 of the phase separation system 160 shown in FIG. 1. The sump 269 can accumulate the solid material 190*c* carried by the wellbore fluid 190. For example, the solid material 190*c* carried by the wellbore fluid 190 can flow into the first tubular 263 via the inlet 263*a*, out of the first tubular 263 via the outlet 263*b*, and settle in the sump 269 due to gravity. In implementations where the first tubular 263 defines perforations, the perforations can be sized, such that the solid material 190*c* can pass through the perforations without getting lodged/stuck in the perforations.

Figure 3:
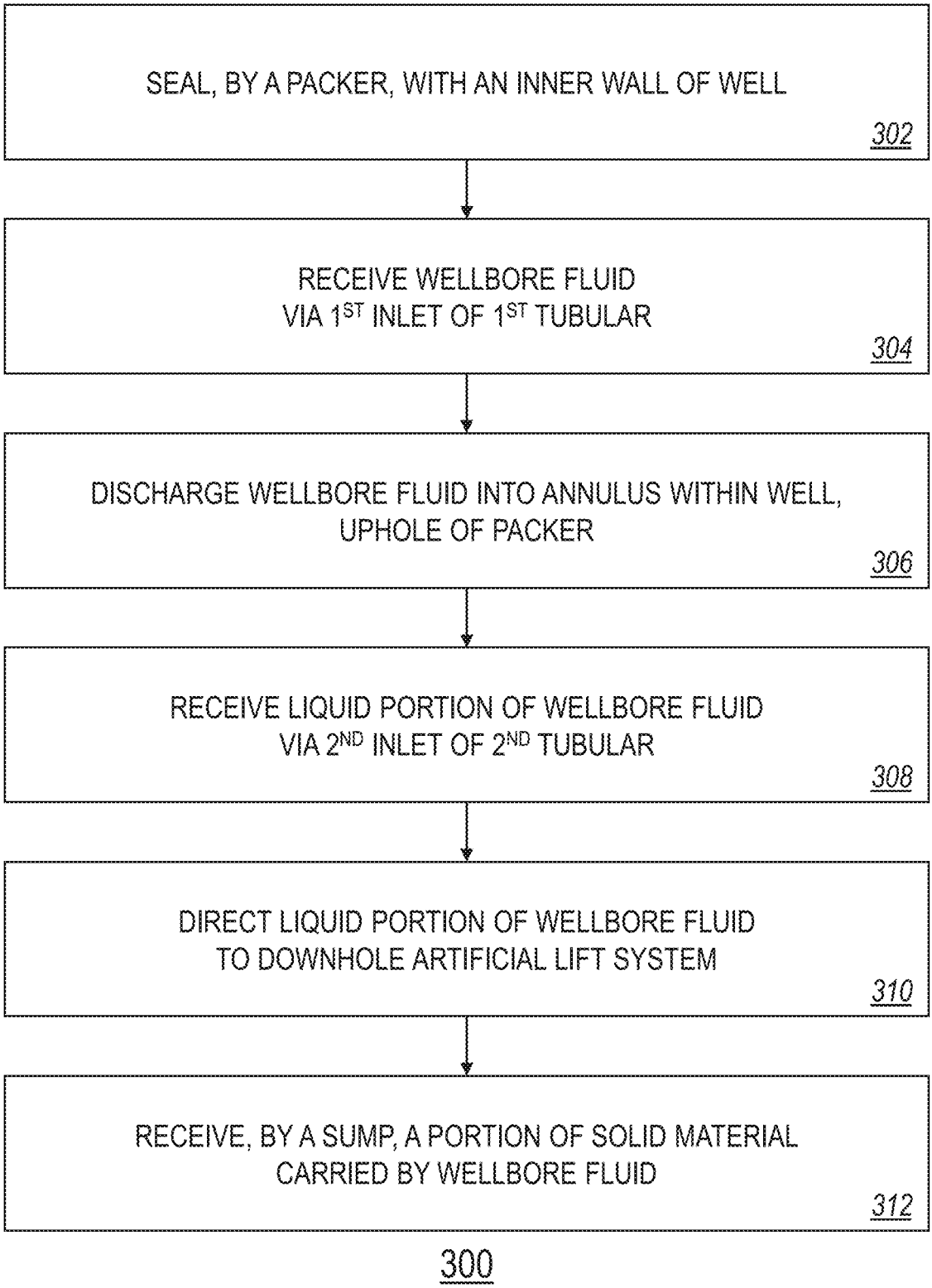
FIG. 3 is a flow chart of an example method for separating phases in a well.

FIG. 3 is a flow chart of an example method 300 for downhole phase separation in a well, such as the well 100. Either of the phase separation systems 160 or 260 can implement the method 300. At block 302, an inner wall of the well 100 (for example, the casing 112) is sealed by a seal (such as the seal 161 or 261) that is disposed in a deviated portion of the well 100.

At block 304, a wellbore fluid (such as the wellbore fluid 190) is received by a first tubular (such as the first tubular 163 or 263) via an inlet (such as the inlet 163*a* or 263*a*, respectively) of the first tubular 163, 263.

At block 306, the wellbore fluid 190 is discharged by an outlet (such as the outlet portion 163*b* or outlet 263*b*) of the first tubular 163, 263 into an annulus (such as the annulus 130*a* or 230*a*) within the well 100, uphole of the seal 161, 261. When the method 300 is implemented by the phase separation system 160, the connector 167 prevents the wellbore fluid 190 from flowing from the first tubular 163 and through the connector 167. Instead, any fluid that flows into the first tubular 163 via the inlet 163*a* flows out of the first tubular 163, for example, through the perforations 163*c* of the outlet portion 163*b*. The perforations 163*c* induce separation of the gaseous portion (such as the gaseous portion 190*a*) of the wellbore fluid 190 from a remainder of the wellbore fluid 190 (for example, the liquid portion 190*b* of the wellbore fluid and the solid material 190*c* carried by the wellbore fluid), as the wellbore fluid 190 flows out of the first tubular 163 through the perforations 163*c*.

At block 308, at least a liquid portion (such as the liquid portion 190*b*) of the wellbore fluid 190 is received by a second tubular (such as the second tubular 165 or 265) via an inlet (such as the inlet 165*a* or 265*a*, respectively) of the second tubular 165, 265. In some implementations, the inlet 165*a*, 265*a* can prevent solid material of a certain size from flowing into the second tubular 165, 265, for example, using a screen. For example, the screen can prevent sand or other particulate matter that is expected to be produced with the production fluid (for example, identified from production data obtained for the well 100) from flowing through the screen and into the second tubular 165, 265 via the inlet 165*a*, 265*a*.

At block 310, the liquid portion 190*b* of the wellbore fluid 190 is directed by the second tubular 165, 265 to a downhole artificial lift system (such as the artificial lift system 150) disposed within the well 100. When the method 300 is implemented by the phase separation system 160, the connector 167 fluidically connects the second tubular 165 to the artificial lift system 150.

At block 312, at least a portion of solid material carried by the wellbore fluid 190 (such as the solid material 190*c*) is received by a sump (such as the sump 169 or 269).

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

As used in this disclosure, the term "deviation angle" is the angle at which a longitudinal axis of a wellbore (or portion of a wellbore that is of interest) diverges from vertical. A deviation angle of 0° or 180° means that the longitudinal axis of the wellbore (or portion of the wellbore that is of interest) is vertical. A deviation angle of 90° means that the longitudinal axis of the wellbore (or portion of the wellbore that is of interest) is horizontal.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A system comprising:

a packer configured to be disposed in a deviated portion of a well formed in a subterranean formation, the packer configured to form a seal with an inner wall of the well;

a first tubular extending through the packer and having a cross-sectional flow area that is smaller than a cross-sectional flow area of the well, the first tubular comprising:

a first inlet configured to receive a wellbore fluid; and a first outlet portion comprising a first outlet and perforations formed on a side wall of the first tubular adjacent the first outlet, the perforations configured to induce separation of a gaseous portion of the wellbore fluid from a remainder of the wellbore fluid, such that the gaseous portion flows uphole through an annulus between the inner wall of the well and the first tubular;

a second tubular comprising:

a second inlet configured to receive at least a liquid portion of the remainder of the wellbore fluid; and a second outlet configured to discharge the liquid portion of the remainder of the wellbore fluid; and a connector coupled to the first tubular and the second tubular, wherein:

the connector is coupled to the first outlet portion of the first tubular, such that the connector is configured to prevent flow of the wellbore fluid from the first tubular through the connector and such that any fluid that flows into the first tubular via the first inlet flows out of the first tubular through the perforations of the outlet portion, the connector is configured to fluidically connect the second tubular to a downhole artificial lift system disposed within the well, uphole of the connector, and a sump for accumulation of solid material from the wellbore fluid is defined by a region of the annulus between the inner wall of the well and the first tubular, downhole of the second inlet of the second tubular and uphole of the packer.

2. The system of claim 1, comprising the well, wherein the packer is disposed in the deviated portion of the well that has a deviation angle in a range of from 70 degrees)(° to 90° (horizontal).

3. The system of claim 2, wherein the first tubular comprises:

a first portion near the first inlet, the first portion having a first deviation angle; and the first outlet portion has a second deviation angle less than the first deviation angle.

4. The system of claim 1, wherein the second tubular has a cross-sectional flow area that is smaller than the cross-sectional flow area of the first tubular.

5. The system of claim 1, wherein the first tubular extends past the packer, and the first inlet is positioned downhole in comparison to the packer.

6. A method comprising:

sealing, by a packer disposed in a deviated portion of a well formed in a subterranean formation, with an inner wall of the well;

receiving, by a first tubular extending through the packer and having a cross-sectional flow area that is smaller than a cross-sectional flow area of the well, a wellbore fluid via a first inlet of the first tubular, the first tubular comprising an outlet portion comprising a first outlet and perforations formed on a side wall of the first tubular adjacent the first outlet, the wellbore fluid comprising a gaseous portion and a liquid portion;

enhancing, by the perforations, a separation of the gaseous portion from the liquid portion of the wellbore fluid;

discharging, by the first tubular and through the perforations, the separated gaseous portion and liquid portion of the wellbore fluid into an annulus within the well, uphole of the packer, wherein the separated gaseous portion rises through the annulus in an uphole direction and the liquid portion falls in the annulus in the downhole direction;

preventing, by a connector coupled to the first outlet of the first tubular, flow of the wellbore fluid through the first outlet;

receiving, by a second tubular coupled to the first tubular, the liquid portion of the wellbore fluid via a second inlet of the second tubular, the second tubular fluidically connected to the connector;

directing, by the second tubular, the liquid portion of the wellbore fluid to a downhole artificial lift system disposed within the well; and receiving, by a sump defined by a region of an annulus between the inner wall of the well and the first tubular, downhole of the second inlet of the second tubular and uphole of the packer, at least a portion of solid material carried by the wellbore fluid.

7. The method of claim 6, wherein the deviated portion of the well in which the packer is disposed has a deviation angle in a range of from 70 degrees)(° to 90° (horizontal).

8. The method of claim 7, wherein the first tubular comprises:

a first portion near the first inlet, the first portion having a first deviation angle; and a second portion near the first outlet, the second portion having a second deviation angle less than the first deviation angle.

9. The method of claim 8, wherein the second tubular has a cross-sectional flow area that is smaller than the cross-sectional flow area of the first tubular.

10. The method of claim 9, wherein the first tubular extends past the packer, and the first inlet is positioned downhole in comparison to the packer.

11. The method of claim 10, wherein:

the first tubular and the second tubular share a common wall that defines a divided section;

the first outlet of the first tubular is disposed at an uphole end of the divided section; and the second inlet of the second tubular is disposed at a downhole end of the divided section, such that fluid flowing from the first tubular to the second tubular flows into the annulus before entering the second tubular.

12. The method of claim 10, comprising fluidically connecting, by the connector, the second tubular to the downhole artificial lift system.

13. The method of claim 12, wherein:

the first tubular comprises a plurality of outlets;

the first outlet is one of the plurality of outlets; and the method comprises inducing, by the plurality of outlets, separation of a gaseous portion of the wellbore fluid from a remainder of the wellbore fluid as the wellbore fluid flows out of the first tubular through the plurality of outlets.

* * * * *